US008610596B2

(12) United States Patent
Johnson

(10) Patent No.: US 8,610,596 B2
(45) Date of Patent: Dec. 17, 2013

(54) MONITORING AND DIAGNOSTICS OF TRAFFIC SIGNAL PREEMPTION CONTROLLERS

(75) Inventor: David Randal Johnson, Oakdale, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 706 days.

(21) Appl. No.: 12/704,118

(22) Filed: Feb. 11, 2010

(65) Prior Publication Data

US 2011/0193722 A1 Aug. 11, 2011

(51) Int. Cl.
*G08G 1/07* (2006.01)
*G08G 1/00* (2006.01)

(52) U.S. Cl.
USPC ..... 340/906; 340/902

(58) Field of Classification Search
USPC ..... 340/906
See application file for complete search history.

(56) References Cited

U.S. PATENT DOCUMENTS

| | | | | |
|---|---|---|---|---|
| 4,914,434 | A * | 4/1990 | Morgan et al. | 340/906 |
| 5,014,052 | A | 5/1991 | Obeck | |
| 5,172,113 | A * | 12/1992 | Hamer | 340/907 |
| 5,187,476 | A | 2/1993 | Hamer | |
| 5,202,683 | A | 4/1993 | Hamer et al. | |
| 5,406,615 | A * | 4/1995 | Miller et al. | 455/552.1 |
| 5,539,398 | A | 7/1996 | Hall et al. | |
| 5,602,739 | A | 2/1997 | Haagenstad et al. | |
| 5,955,968 | A * | 9/1999 | Bentrott et al. | 340/906 |
| 5,973,616 | A * | 10/1999 | Grebe et al. | 340/906 |
| 6,064,319 | A | 5/2000 | Matta | |
| 6,985,090 | B2 | 1/2006 | Ebner et al. | |
| 7,307,547 | B2 | 12/2007 | Schwartz | |
| 7,333,028 | B2 | 2/2008 | Schwartz | |
| 7,417,560 | B2 | 8/2008 | Schwartz | |
| 2003/0128135 | A1 * | 7/2003 | Poltorak | 340/906 |
| 2005/0104745 | A1 * | 5/2005 | Bachelder et al. | 340/906 |
| 2008/0316055 | A1 | 12/2008 | Bachelder et al. | |

FOREIGN PATENT DOCUMENTS

| | | | | |
|---|---|---|---|---|
| WO | WO 2005/094544 | | 10/2005 | |
| WO | WO 2006/115756 | A1 * | 4/2006 | G06K 7/00 |
| WO | WO 2006/130633 | | 12/2006 | |
| WO | WO 2006/138364 | | 12/2006 | |

* cited by examiner

*Primary Examiner* — Brian A. Zimmerman
*Assistant Examiner* — Cal Eustaquio
(74) *Attorney, Agent, or Firm* — Crawford Maunu PLLC

(57) ABSTRACT

Management of traffic signal preemption control equipment. In one approach, logged preemption data is periodically read from each of a plurality of intersections having respective preemption controllers for preempting traffic signals at the intersections. The logged preemption data at an intersection describes operational states of the preemption controller and each vehicle control unit that submitted a preemption request at the intersection and data describing each individual preemption request. The logged preemption data read from the plurality of intersections are stored in a database. The database is monitored for data indicative of changes in operational status of the traffic signal preemption control equipment. In response to the data indicating a change in operational status, data descriptive of the change are output.

20 Claims, 10 Drawing Sheets

*preemption log entries* 422

| Date | Time | Intersection | Vehicle Name | Emitter | Preempt |
|---|---|---|---|---|---|
| 1/18/2010 | 1:14:21 PM | Barranca & Park | Engine 205 | 5002 | Yes |
| 1/18/2010 | 1:14:08 PM | Barranca & Marvin | Engine 205 | 5002 | Yes |
| 1/18/2010 | 1:13:17 PM | Barranca & Lake | Engine 205 | 5002 | Yes |
| ⋮ | | | | | |

FIG. 4-2

*preemption controller status records* 424

| Date | Time | Intersection | Severity | Operation | Description |
|---|---|---|---|---|---|
| 1/18/2010 | 11:14:21 AM | Central & Culver | ⓧ Error | Get logs | Communication timed out |
| 1/18/2010 | 9:37:41 AM | Alta & Culver | ⚠ Warning | Configuration changed | |
| 1/18/2010 | 9:37:07 PM | University & Culver | ⓘ Info | Set configuration | |
| ⋮ | | | | | |

FIG. 4-3

MONITORING AND DIAGNOSTICS OF TRAFFIC SIGNAL PREEMPTION CONTROLLERS

FIELD OF THE INVENTION

The present invention is generally directed to traffic control preemption systems.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the Opticom® system. This system utilizes a high power strobe tube (emitter), located in or on the vehicle, that generates light pulses at a predetermined rate, typically 10 Hz or 14 Hz. A receiver, which includes a photo detector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the Opticom® GPS priority control system. This system utilizes a GPS receiver in the vehicle to determine location, speed, and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle are used to determine the estimated time of arrival (ETA) at the intersection and the travel distance from the intersection. ETA and travel distances are associated with each intersection approach to determine when a detected vehicle is within range of the intersection and, therefore, a preemption candidate. Preemption candidates with valid security codes are reviewed with other detected vehicles to determine the highest priority vehicle. Vehicles of equivalent priority are generally selected in a first come, first served manner. A preemption request is issued to the controller for the approach direction with the highest priority vehicle travelling on it.

With metropolitan-wide networks becoming more prevalent, additional means for detecting vehicles via wired networks such as Ethernet or fiber optics and wireless networks such as Mesh or IEEE 802.11b/g may be available. With network connectivity to the intersection, vehicle tracking information may be delivered over a network medium. In this instance, the vehicle location is either broadcast by the vehicle itself over the network or it may broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed, and heading, along with the current time. Intersections on the network receive the vehicle information and evaluate the position using approach maps as described in the Opticom® GPS system. The security coding could be identical to the Opticom® GPS system or employ another coding scheme.

As used herein, the term "vehicle control unit" refers to the various types of modules capable of communicating a preemption request to a preemption controller. This includes, for example, IR light based modules, GPS based modules, and wireless network based modules. In addition, a preemption request refers to both preemption requests that emanate from emergency vehicles and to what are sometimes referred to as "priority requests," which emanate from mass transit vehicles, for example.

SUMMARY

The embodiments of the invention provide management of traffic signal preemption control equipment. In one embodiment, a method periodically reads logged preemption data from each of a plurality of intersections having respective preemption controllers for preempting traffic signals at the intersections. The logged preemption data at an intersection describes operational states of the preemption controller and each vehicle control unit that submitted a preemption request at the intersection and data describing each individual preemption request. The logged preemption data read from the plurality of intersections are stored in a database. The database is monitored for data indicative of changes in operational status of the traffic signal preemption control equipment. In response to the data indicating a change in operational status, data descriptive of the change are output.

In another embodiment, a system is provided for managing geographically dispersed traffic signal preemption control equipment. The system includes a processor and a memory arrangement coupled to the processor. The memory is configured with instructions for execution by the processor. The instructions include a first module for periodically reading logged preemption data stored at each of a plurality of intersections having respective preemption controllers for preempting traffic signals at the intersections. The first module stores the logged preemption data read from the plurality of intersections in a database in the memory arrangement. The logged preemption data describes operational characteristics of the preemption controller and each vehicle control unit that submitted a preemption request at the intersection and data describing each individual preemption request. A second module is provided for monitoring the database having the logged preemption data from the plurality of intersections for data indicative of changes in operational status of the traffic signal preemption control equipment. A third module is responsive to the data indicating a change in operational status. The third module outputs data for graphical display on a map of roadways and intersections. The data for graphical display includes graphical icons indicative of the operational status of the preemption control equipment at map locations corresponding to geographic locations of the preemption control equipment.

An article of manufacture is provided in another embodiment. The article of manufacture includes a processor-readable storage device configured with instructions for managing geographically dispersed traffic signal preemption control equipment. Executing the instructions by one or more processors causes the one or more processors to perform the operations including periodically reading logged preemption data stored at each of a plurality of intersections having respective preemption controllers for preempting traffic signals at the intersections. The logged preemption data at an intersection describes operational states of the preemption controller and each vehicle control unit that submitted a preemption request at the intersection and data describing each individual preemption request. The operations further include storing the logged preemption data read from the plurality of intersections in a database in an electronic storage device. The database having the logged preemption data from the plurality of intersections is monitored for data indicative of changes in operational status of the traffic signal preemption control equipment. In response to the data indicating a change in operational status, data descriptive of the change are output.

The above summary of the present invention is not intended to describe each disclosed embodiment of the present invention. The figures and detailed description that follow provide additional example embodiments and aspects of the present invention.

BRIEF DESCRIPTION OF THE DRAWINGS

FIG. 4-1 shows an example screen shot of a display monitor in which the screen shot contains various icons overlaid on a road map to indicate the operational status of traffic signal preemption control equipment;

FIG. 4-2 shows example entries in a preemption log table;

FIG. 4-3 shows a table of example status records;

DETAILED DESCRIPTION

Each preemption controller logs preemption data that describe preemptions of the traffic signal and also stores data that describe the operational state of the preemption controller at an intersection. The data that describe preemptions include vehicle identifiers, dates and times of the start and end of the preemption request, the path of travel of the requesting vehicle, turn signal status, and preemption signal strength, for example.

Data stored at each preemption controller support maintenance of the controller. However, access to the data in prior systems was made by way of connecting a portable computer to the preemption controller at the intersection where the preemption controller was installed. Thus, periodic maintenance checks required travel to geographically dispersed traffic signal preemption control equipment and determining whether or not there was a maintenance issue to be addressed at that intersection. In addition, a gradual decline in preemption system performance was not readily apparent to service personnel when reviewing call history from a single intersection over a limited time period.

The various embodiments of the invention provide approaches for managing geographically dispersed traffic signal preemption controllers. Generally, preemption data logged at the intersections are periodically gathered by a centralized management system and the preemption data are monitored for equipment operating anomalies and misuse of the system. In one approach, a centralized management system operating on one or more computers, periodically reads logged preemption data stored by preemption controllers at each of a plurality of intersections. Along with data describing each individual preemption request, the logged preemption data at an intersection describes operational characteristics of the preemption controller and each vehicle control unit that submitted a preemption request at the intersection. The centralized management system stores the retrieved logged preemption data in a database and monitors the database for data indicative of changes in operational status of the traffic signal preemption control equipment. In response to the data indicating a change in operational status, the centralized management system outputs data descriptive of the change.

Figure 1:
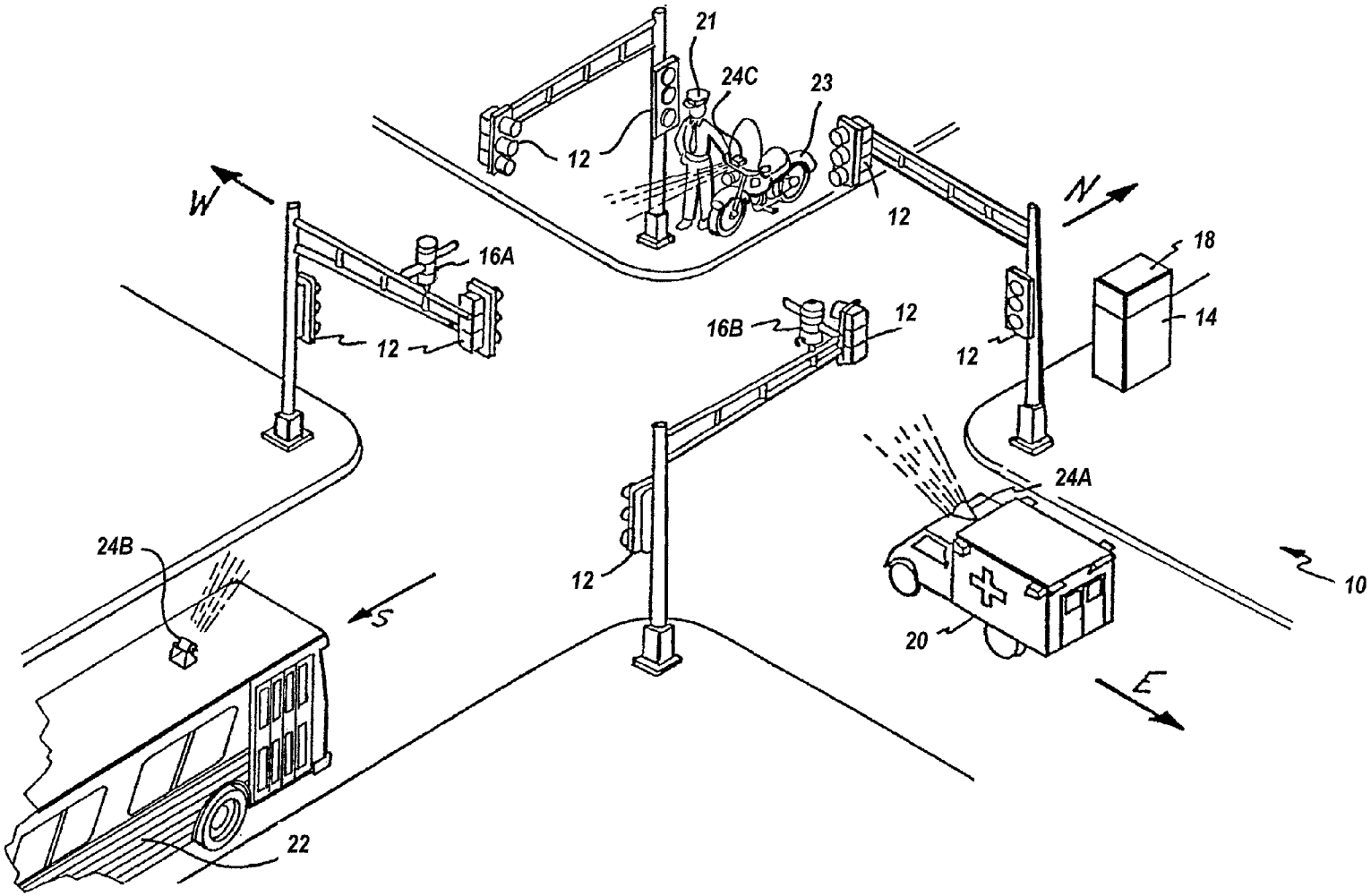
FIG. 1 is an illustration of a typical intersection having traffic signal lights.

FIG. 1 is an illustration of a typical intersection 10 having traffic signal lights 12. The equipment at the intersection illustrates the environment in which embodiments of the present invention may be used. A traffic signal controller 14 sequences the traffic signal lights 12 to allow traffic to proceed alternately through the intersection 10. The intersection 10 may be equipped with a traffic control preemption system such as the Opticom® Priority Control System, the OPTICOM GPS priority control system, or a networked system.

The traffic control preemption system shown in FIG. 1 includes detector assemblies 16A and 16B, signal emitters 24A, 24B and 24C (also referred to herein as "vehicle control units"), a traffic signal controller 14, and a phase selector 18 (also referred to herein as a "preemption controller"). The detector assemblies 16A and 16B are stationed to detect signals emitted by authorized vehicles approaching the intersection 10. The detector assemblies 16A and 16B communicate with the phase selector, which is typically located in the same cabinet as the traffic controller 14.

In FIG. 1, an ambulance 20 and a bus 22 are approaching the intersection 10. The signal emitter 24A is mounted on the ambulance 20 and the signal emitter 24B is mounted on the bus 22. The signal emitters 24A and 24B each transmit a signal that is received by detector assemblies 16A and 16B. The detector assemblies 16A and 16B send output signals to the phase selector. The phase selector processes the output signals from the detector assemblies 16A and 16B to determine the signal characteristics including: frequency, intensity, and security code of the signal waveform, or pulses. The security code, consisting of the vehicle class and vehicle identification is encoded in the signal by interleaving data pulses between the base frequency pulses. In GPS systems, location, speed, and heading of the vehicle are also determined and transmitted. If an acceptable frequency, intensity, and or security code is observed, the phase selector generates a preemption request to the traffic signal controller 14 to preempt a normal traffic signal sequence. The phase selector alternately issues preemption requests to and withdraws preemption requests from the traffic signal controller, and the traffic signal controller determines whether the preemption requests can be granted. The traffic signal controller may also receive preemption requests originating from other sources, such as a nearby railroad crossing, in which case the traffic signal controller may determine that the preemption request from the other source be granted before the preemption request from the phase selector. In some embodiments of the present invention the function of the phase selector is performed solely by the traffic signal controller.

The traffic signal controller determines the priority of each signal received and whether to preempt traffic control based on the security code contained in the signal. For example, the ambulance 20 may be given priority over the bus 22 since a human life may be at stake. Accordingly, the ambulance 20 would transmit a preemption request with a security code indicative of a high priority while the bus 20 would transmit a preemption request with a security code indicative of a low priority. The phase selector would discriminate between the low and high priority signals and request the traffic signal controller 14 to cause the traffic signal lights 12 controlling the ambulance's approach to the intersection to remain or become green and the traffic signal lights 12 controlling the bus's approach to the intersection to remain or become red.

When a preemption request is received, the phase selector (preemption controller) stores a record of the request in a preemption log. Each stored entry in the log includes preemption data such as: the emitter code of the requesting vehicle; the time and date of the request; the direction or approach from which the request was received; whether the request was granted; etc. This stored information can later be uploaded to a central management server and used to analyze preemption use and or generate reports. To assure correct operation of preemption control of each intersection, some embodiments store the status of the lights at the end of preemption control. The status indicates the direction in which traffic was preempted, which phases (straight or turn lanes) were green when preemption control ended, and the duration of that green state. This information can be compared at the central control server to determine if the preemption controller of the intersection is operating as expected.

Figure 2:
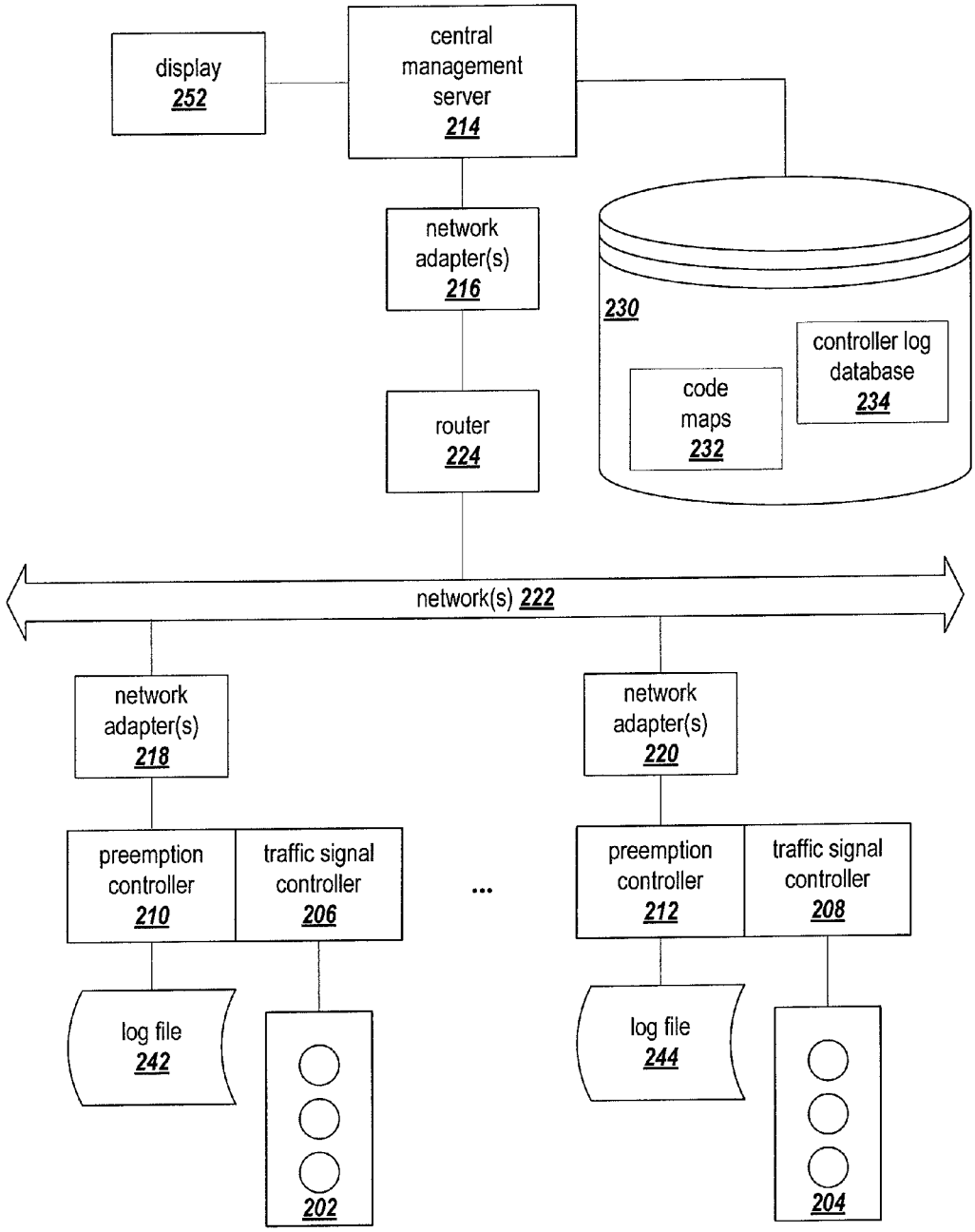
FIG. 2 is a block diagram of an example system for managing traffic signal preemption in accordance with an embodiment of the invention.

FIG. 2 is a block diagram of an example system for managing traffic signal preemption in accordance with an embodiment of the invention. Traffic lights 202 and 204 at intersections with preemption controllers are coupled to traffic signal controllers 206 and 208, respectively. Traffic signal controllers 206 and 208 are connected to respective preemption controllers 210 and 212. Each preemption controller is configured to store a log of preemption request data in local storage (not shown). A central management server 214 and the preemption controllers are respectively coupled to network adapters 216, 218, and 220 for communication over a network 222. In various embodiments, a router or a network switch, as shown by router 224, may be coupled between the network adapter and the network. It is understood the central management server 214 and the preemption controllers 210 and 212 may be connected through more than one network, coupled by additional switches and routing resources, including a connection over the Internet.

The central management server 214 is additionally coupled to a database server 230. Code maps 232 contain respective sets of codes for the jurisdictions managed by the central management server 214 and are stored on server 230. A controller log database 234 is also stored on server 230. It is understood that database server 230 may comprise several local and/or remote servers.

The central management server 214 periodically gathers preemption data logged at the intersections, and the preemption data are monitored for equipment operating status, anomalies and misuse of the system. The preemption data are associatively stored in the controller log database 234. In one embodiment, each preemption controller 210 and 212 maintains a respective log file 242 and 244. The data stored in each log file describe each preemption request for the associated intersection. In one embodiment, the data include a vehicle control unit identifier, a date and time of the preemption request, and the duration of the preemption. The logged preemption data at an intersection further describe operational characteristics of the preemption controller and each vehicle control unit that submitted a preemption request at the intersection. This data include, for example, whether the preemption controller is operating normally, is offline, or is non-responsive. For vehicle control units, values describing the signal strength are stored for each preemption request. The signal strength may be used to identify maintenance issues for both vehicle control units and for preemption controllers.

The centralized management system monitors the database 234 for data indicative of changes in operational status of the traffic signal preemption control equipment. In response to the data indicating a change in operational status, the centralized management system outputs data descriptive of the change. In one embodiment, the status may be communicated by way of updating a display monitor 252. Other channels may be used to communicate the status information. For example, status information may be output and communicated via email messages, telephone or text messages, or electronic messages directed to other software applications.

In another embodiment, the central management server 214 monitors the database for data indicative of anomalies and reports such occurrences accordingly. Such anomalies include, for example, decreasing signal strength for a particular vehicle control unit or a particular preemption controller showing a lesser signal strength for all vehicle control units as compared to other preemption controllers. The data may indicate a particular vehicle control unit is in need of service or repair if the signal strength from that vehicle control unit is below a desired threshold as received and logged at multiple preemption controllers. The data may indicate that a preemption controller (or other receiving equipment) is in need of service or repair if the signal strengths from multiple vehicle control units as logged by that preemption controller are less than the signal strengths from those same vehicle control units as logged by other preemption controllers.

It is understood that numerous network transfer protocols may be used to establish, maintain, and route connections including: TCP/IP, UDP, NFS, ESP, SPX, etc. It is also understood that network transfer protocols may utilize one or more lower layers of protocol communication such as ATM, X.25, or MTP, and on various physical and wireless networks such as, Ethernet, ISDN, ADSL, SONET, IEEE 802.11, V.90/v92 analog transmission, etc.

Figure 3:
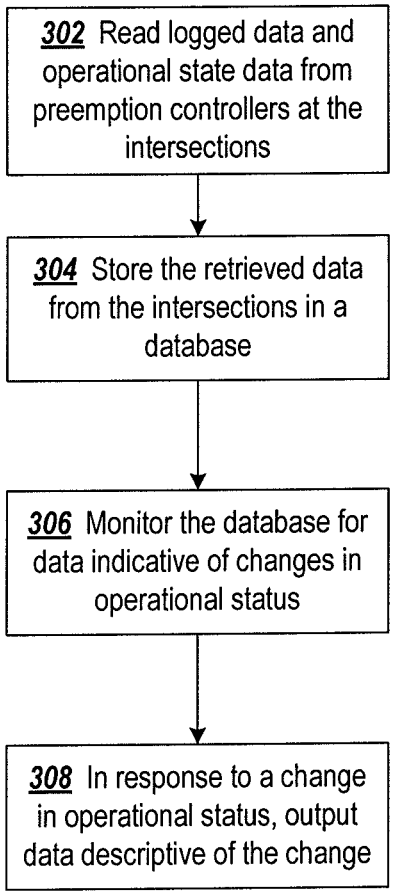
FIG. 3 is a flowchart of an example process for managing geographically dispersed traffic signal preemption control equipment.

FIG. 3 is a flowchart of an example process for managing geographically dispersed traffic signal preemption control equipment. At step 302, logged data and operational state data are read from various preemption controllers that are situated at respective intersections. The logged data include data that describe each preemption request at each intersection. The operational state data includes the operational state of each preemption controller, as well as additional diagnostic data such as vehicle detector health, wiring issues such as green sense data never changing, memory errors, and line voltage irregularities. In one embodiment, a central computer system is coupled to the preemption controllers and is programmed to read the logged data periodically. It will be appreciated that multiple computers may be involved in the reading of the logged data and storing the data in a distributed database. The embodiments of the invention provide centralized monitoring of the data retrieved from the preemption controllers.

At step 304, the retrieved data are stored in a database for subsequent retrieval and analysis using any of a variety of suitable database engines. At step 306, the data in the database are monitored for changes that indicate changes in operational state of the preemption control equipment. Such changes generally include newly added preemption requests, expired preemptions, status of vehicle control units, and status of preemption controllers, for example.

At step 308, a change in operational status is communicated by way of outputting data descriptive of the change. The data may be output to a display monitor on which a map of roads, intersections, vehicle icons, and preemption controller icons is displayed. The data may also or alternatively be communicated via other channels as described above.

Figures 1, 4:
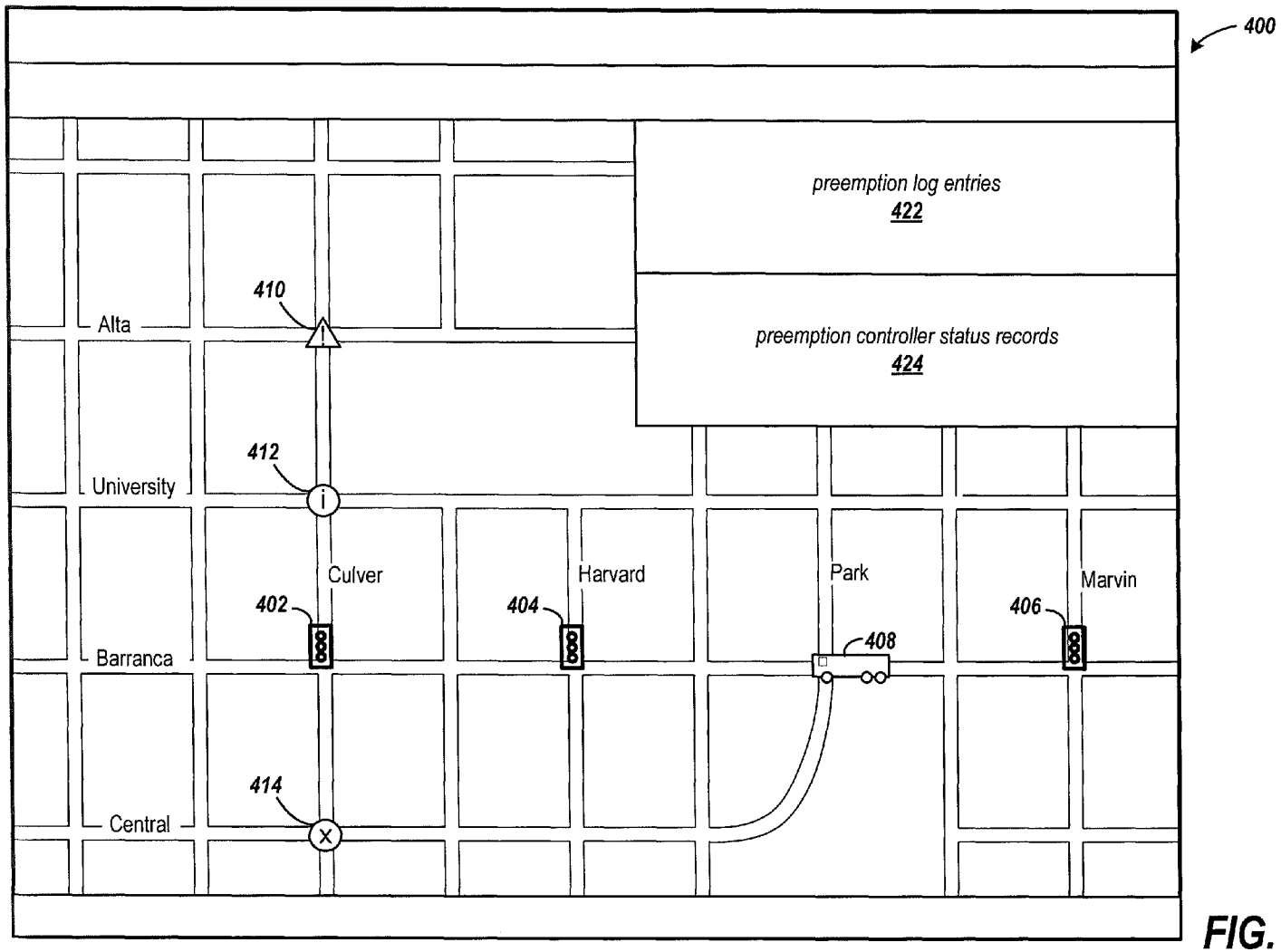

FIG. 4-1 shows an example screen shot 400 of a display monitor in which the screen shot contains various icons overlaid on a road map to indicate the operational status of traffic signal preemption control equipment. The screen shot 400 includes a network of roadways and intersections for a selected geographic area as may be provided by a geographic information system. Overlaid on the map are icons corresponding to preemption controllers at various intersections and icons corresponding to vehicle control units making preemption requests. The operational state of each preemption controller is indicated by a particular icon displayed at an intersection on the map. For example, different shapes may indicate that the preemption controller is operational, is uncommunicative, or is reporting a problem.

Traffic signal icons 402, 404, and 406 are displayed at the intersections of Barranca & Culver, Barranca & Harvard, and Barranca & Marvin. A fire engine icon 408 is displayed at the intersection of Barranca & Park. Informational icons 410, 412, and 414 are displayed at the intersections of Alta & Culver, University & Culver, and Central & Culver.

Along with the icons, a tabular display of preemption controller data is presented in tables 422 and 424. Table 422 contains preemption log entries, and table 424 contains preemption controller status records. FIG. 4-2 shows example preemption log entries for table 422, and FIG. 4-3 shows example status records for table 424. The example entries in the tables shown in FIGS. 4-2 and 4-3 generally correspond to the icons in FIG. 4-1. It will be appreciated that selected information contained in tables 422 and 424 may be displayed near an icon as a user mouses-over the icon shown in FIG. 4-1.

Table 422 in FIG. 4-2 shows three log entries describing preemptions initiated from Engine 205. Engine 205 corresponds to icon 408 displayed in FIG. 4-1. At 1:13:17 PM, preemption was granted in response to a request from Engine 205 at the intersection of Barranca & Lake (not shown in FIG. 4-1). At 1:14:08 PM, preemption was granted in response to a request from Engine 205 at the intersection of Barranca & Marvin. The most recent entry shown in the table shows that at 1:14:21 PM, preemption was granted in response to a request from Engine 205 at the intersection of Barranca & Park. Note that instead of a traffic signal icon, the fire engine icon 408 is displayed in FIG. 4-1 to signify that the preemption is active. In one embodiment, the fire engine icon remains displayed for a user-configurable duration once the preemption has ended, at which time a traffic signal icon is displayed at the intersection. As preemption is granted to Engine 205 at the intersections of Barranca & Harvard and then at Barranca & Culver, the traffic signal icons at those intersections will be replaced with the fire engine icon.

Table 424 in FIG. 4-3 shows example status records gathered from preemption controllers. The example status records correspond to the icons shown in FIG. 4-1. A warning icon is displayed at the intersection of Alta & Culver. The warning icon 410 corresponds to the entry in the status record table 424 that explains that at 9:37:41 AM, the configuration of the preemption controller at Alta & Culver was changed. The informational icon 412 at the intersection of University & Culver in FIG. 4-1 corresponds to the entry in table 424 that indicates that the configuration of the preemption controller at the intersection of University & Culver was set at 9:37:07 AM. The error icon 414 at the intersection of Central & Culver in FIG. 4-1 corresponds to the entry in table 424 that indicates that in attempting to obtain the log files from the preemption controller at Central & Culver, communication with the preemption controller timed out, and the log files could not be obtained.

Figure 5:
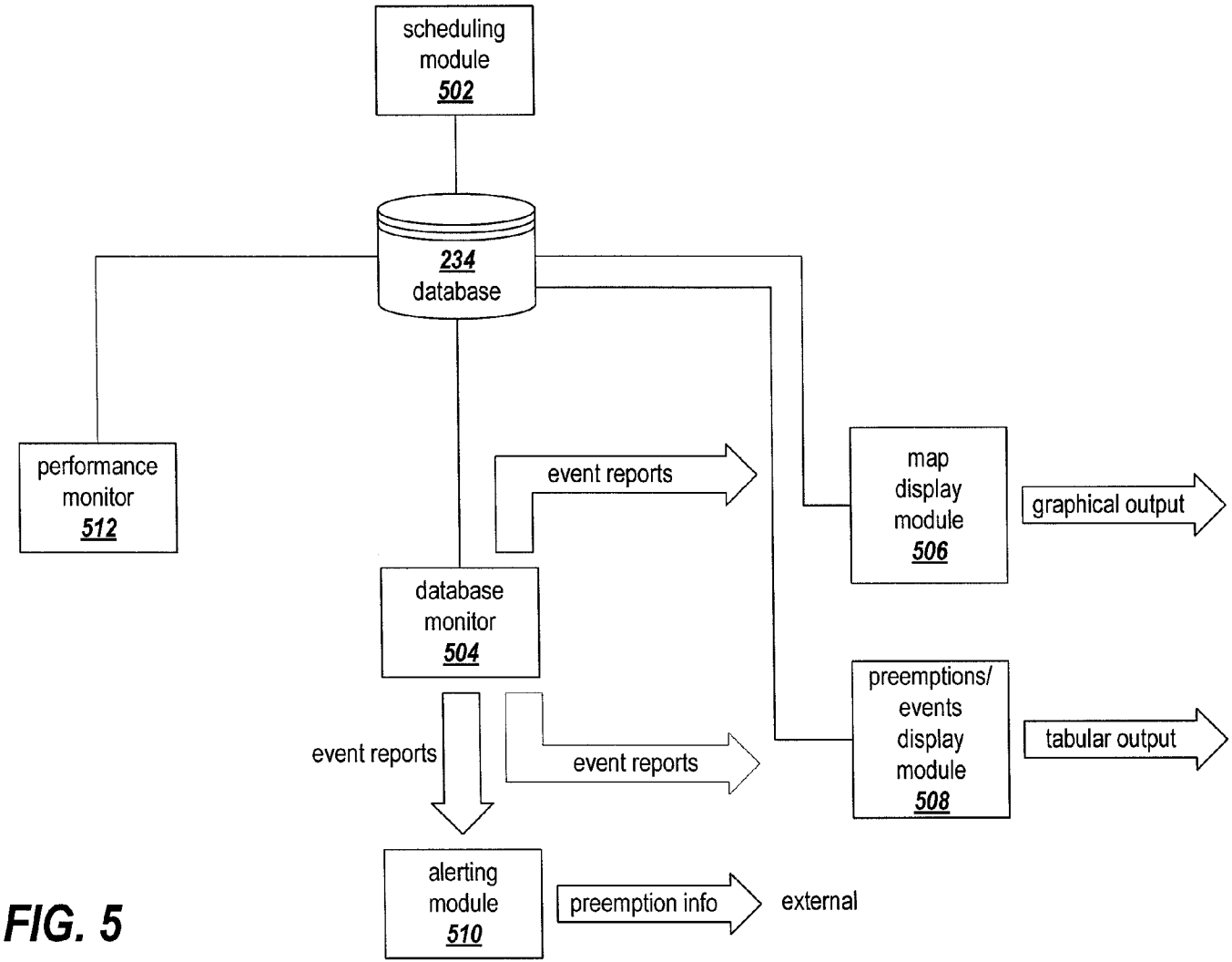
FIG. 5 is a block diagram of an example system for managing geographically dispersed traffic signal preemption control equipment.

FIG. 5 is a block diagram of an example system for managing geographically dispersed traffic signal preemption control equipment. Scheduling module 502 periodically polls the log files of the preemption controllers for updated preemption and status data. New data are stored in database 234. The database monitor 504 monitors the database 234 for data indicative of changes in operational status of the traffic signal preemption control equipment and reports occurrences of events to modules that have registered to receive reports. The map display module 506 displays information for each intersection that is equipped with a preemption controller and receives events from the database monitor. The preemptions/events display module 508 displays detailed information describing each granted preemption in response to events reported by the database monitor. The alerting module 510 forwards event information to other software applications, for example, to external organizations that may further process the logged preemption data, such as for estimating arrival times of vehicles. The performance monitor 512 monitors the database for changes in key indicators that could indicate degradation in system performance.

Figure 6:
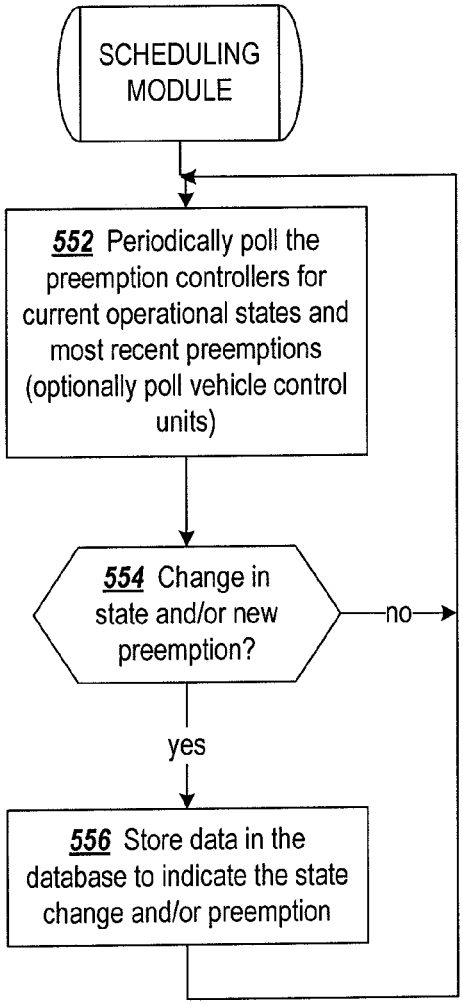
FIG. 6 is a flowchart of an example process performed by the scheduling module in accordance with an embodiment of the invention.

FIG. 6 is a flowchart of an example process performed by the scheduling module in accordance with an embodiment of the invention. At step 552, the scheduling module periodically polls the preemption controllers for the current operational state as indicated by the status records stored at the preemption controllers (e.g., normal, broken, offline, etc.) and for the most recent preemption requests. In a normal state, a traffic signal icon is displayed, in a broken state an error icon is displayed, and in an offline state a warning icon is displayed.

In response to detecting a change in state or that a new preemption request has been received at step 554, the scheduling module stores the log data in the database at step 556. The log data stored in the database are supplemented with or associated with further data available on the server. The supplemental data include the name of the intersection from which the data were uploaded, a vehicle name associated with the vehicle control unit identifier, an agency name, or a jurisdiction name, for example.

The scheduling module also periodically reads extended configuration information from the preemption controllers and stores this data in the database. The clock in the preemption controller may be periodically set by the scheduling module to correct any clock drift.

In another embodiment, the preemption equipment may include vehicle control units that interface with wireless networks such as Mesh or IEEE 802.11b/g. The scheduler may be configured to directly poll those vehicle control units for identifier and location data in combination with polling the preemption controllers. The data received from the vehicle control units is supplemented and stored in the database as described above.

Figure 7:
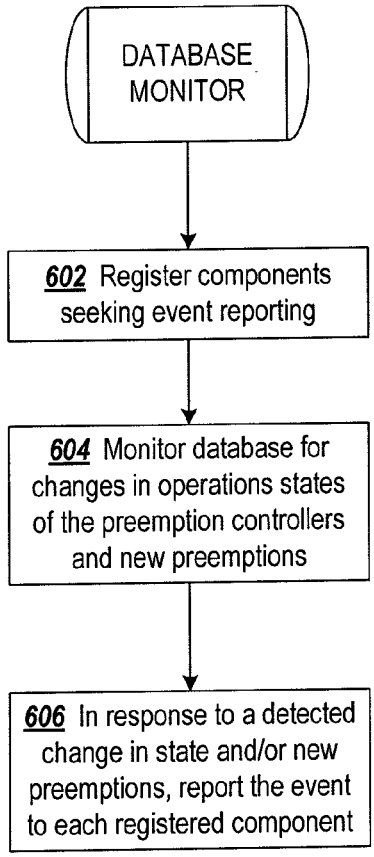
FIG. 7 is a flowchart of an example process performed by the database monitor in accordance with an embodiment of the invention.

FIG. 7 is a flowchart of an example process performed by the database monitor in accordance with an embodiment of the invention. At step 602, the database monitor registers components or modules seeking reports of events detected by the database monitor. The database monitor, at step 604, periodically reads data from the database looking for changes in operational state of the preemption controllers and looking for new preemptions of traffic signals. At step 606, in response to detecting either a change in operational state or a new preemption, the database monitor transmits a report of the event to any registered component or module. Event registration and reporting may be implemented using known software techniques for event reporting.

In another embodiment, the database monitor is configured to monitor the database for changes in location of one or more selected vehicles. This data may have been gathered by the scheduling module directly from vehicle control units. Changes in location may be reported as events to the map display module 506.

Figure 8:
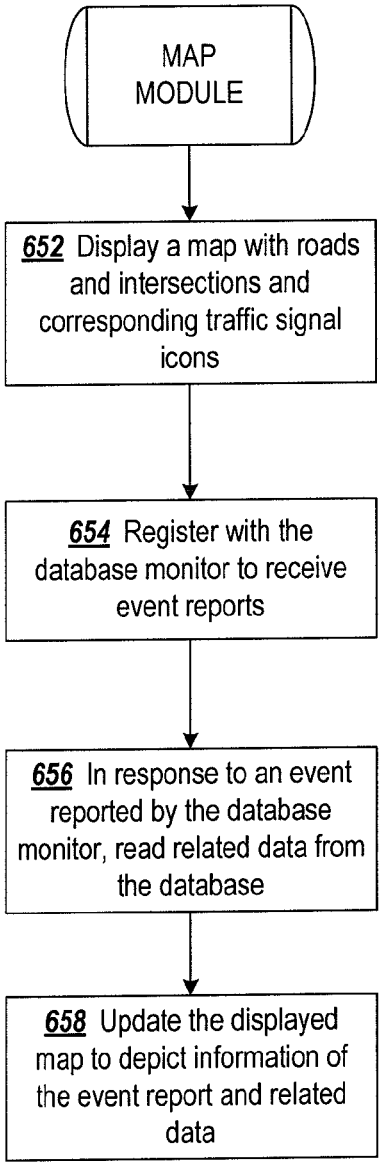
FIG. 8 is a flowchart of an example process performed by the map display module in accordance with an embodiment of the invention.

FIG. 8 is a flowchart of an example process performed by the map display module in accordance with an embodiment of the invention. At step 652, the map display module displays a map with roads and intersections and traffic signal icons corresponding to monitored preemption controllers. The map display module registers with the database monitor at step 654 to receive reports of changes in operational status of the preemption controllers and new preemption requests.

In response to an event reported by the database monitor, at step 656 the map display module reads related data from the database. For example, in response to a change in state of a preemption controller, the map display module reads the related intersection name from the database. For a new preemption, the map display module reads the vehicle name, vehicle control unit identifier (emitter number if FIG. 4-2), the vehicle's direction of travel (if applicable), and the time and duration of the preemption.

At step 658, the map display module updates the displayed map to reflect and describe the occurrence of the event. For a change in state of a preemption controller, the icon at an intersection may be changed to indicate whether the controller is normal, broken, or offline, for example. For a preemption, the map is updated to show a vehicle icon at the intersection at which the preemption occurred. The preemption log entry table 422 is updated to include entries for the new preemptions.

In another embodiment, the map display module registers with the database monitor to receive events that are based on location changes of vehicles that communicate directly with the scheduling module. The map display module displays vehicle icons on the map at locations corresponding to the reported locations.

Figure 9:
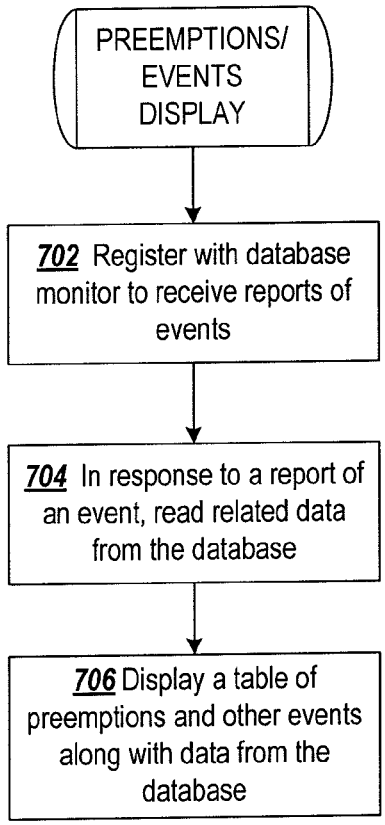
FIG. 9 is a flowchart of an example process performed by a module for displaying information describing preemptions and events occurring in the preemption control equipment.

FIG. 9 is a flowchart of an example process performed by a module for displaying information describing preemptions and events occurring in the preemption control equipment. In one embodiment, data descriptive of preemptions are displayed in one table, and data descriptive of preemption controller status events are displayed in a second table. The displayed data includes related information read from the database. The two tables correspond to tables 422 and 424 in FIGS. 4-1-4-3.

At step 702, the module registers with the database monitor to receive reports of changes in operational status of preemption controllers and reports of new preemptions. In response to a reported event, at step 704 the module reads related data from the database.

For a preemption controller status event, the event report indicates an identifier of the preemption controller to the module. In response, the module reads the intersection name, communications channel, event severity (Info, Error, Warning), and associated event description data from the database.

For a new preemption event, the event report indicates an identifier of the preemption controller to the module. In response, the module reads the intersection name, direction of travel, vehicle name, vehicle's agency, vehicle code, vehicle priority, start time, preemption duration, green sense data, signal strength, turn single status, preemption granted, and vehicle authorized.

In an example embodiment, separate tables are displayed for preemption controller status data and new preemption data at step 706.

Figure 10:
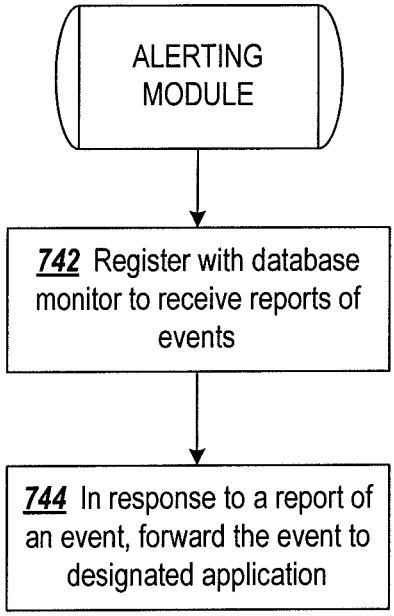
FIG. 10 is a flowchart of an example process for forwarding event-related data to additional applications.

FIG. 10 is a flowchart of an example process for forwarding event-related data to additional applications. For example, preemption data, such as the time, location, and vehicle identifier, may be forwarded to an emergency personnel tracking application or dispatching system. Such systems may use the preemption data to estimate time of arrival of emergency personnel or alerting transit passengers of the expected time of arrival of the next bus.

At step 742, the alerting module registers with the database monitor to receive reports of events. In response to receiving an event report, the alerting module forwards information describing the event to another software application at step 744 for further processing.

Figure 11:
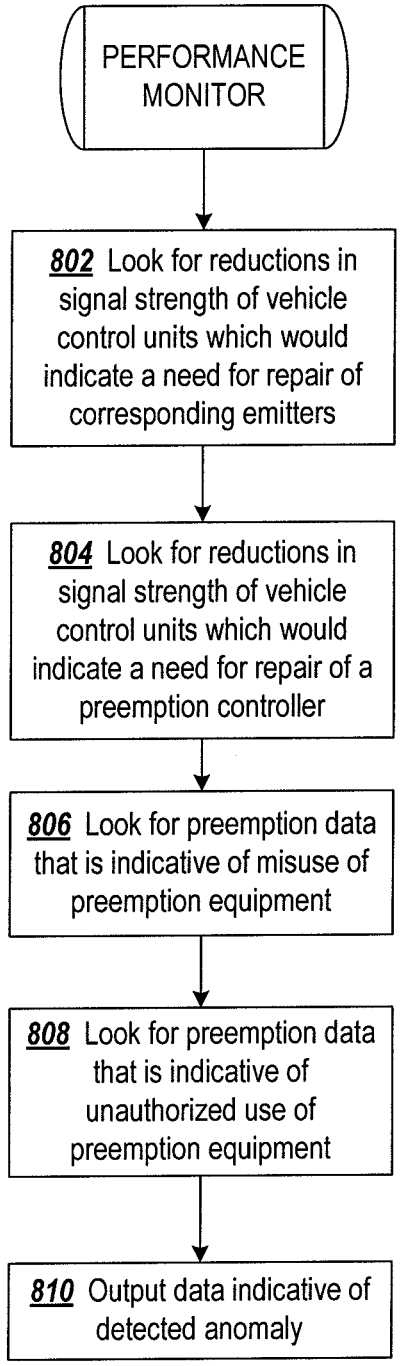
FIG. 11 is a flowchart of an example process performed by the performance monitor in accordance with an embodiment of the invention.

FIG. 11 is a flowchart of an example process performed by the performance monitor in accordance with an embodiment of the invention. The performance monitor analyzes data from the database in search of patterns that are indicative of an anomaly in operation of the preemption equipment. Those skilled in the art will recognize that the operational anomalies shown in FIG. 11 and described below are examples showing how the logged preemption data may be used to detect and diagnose issues involving the preemption equipment. The framework of the embodiments described herein may be expanded to detect and diagnose issues in addition to the examples below.

The data in the log files includes signal strength levels of vehicle control units making preemption requests as detected by the preemption controllers. At step 802, the performance monitor looks for reductions in signal strength that indicate those vehicle control units in need of repair or maintenance. For example, where the signal strength level of a particular vehicle control unit is below a certain threshold at multiple intersections, there is a strong possibility that the vehicle control unit is in need of repair. Since the signal strength levels are considered across multiple intersections, the likelihood of false positives may be reduced.

The vehicle control unit signal strength levels may also be used in determining that a preemption controller is in need of repair. For example, if the signal strength levels detected by a particular preemption controller for all the vehicle control units is below a certain threshold or mean of the signal strength levels is below a certain threshold, the data may indicate that the preemption controller is in need of maintenance or repair. At step 804, the performance monitor looks for reductions in signal strength of vehicle control units that point to a preemption controller needing repair or maintenance.

Misuse of preemption equipment may also be detected from the preemption log files at one or more intersections. Various patterns of preemption data may indicate the misuse. For example, if a particular vehicle control unit makes more than a threshold number of preemption requests in a certain period of time, misuse of the vehicle control unit may be indicated. Also, if a particular vehicle control unit makes preemption requests at the same intersection at approximately the same time each day for some number of days, misuse may be indicated. At step 806, the performance monitor looks for preemption data that is indicative of unauthorized use of the equipment.

Unauthorized use of the preemption equipment may also be detected from the preemption log files at one or more intersections. For each preemption request, the preemption log data includes the identifier of the vehicle control unit that made the request. The vehicle control unit identifier is transmitted in the request from the vehicle control unit to the preemption controller. At step 808, if the vehicle control unit has not been properly configured with an authorized identifier, some installations may consider the vehicle control unit to be unauthorized for use. For example, if the logged vehicle control unit identifier for a preemption is 0, the preemption may be deemed to have been unauthorized.

If one of the above-mentioned anomalies is detected, data is output to alert a traffic engineer of the occurrence anomaly at step 810.

Figure 12:
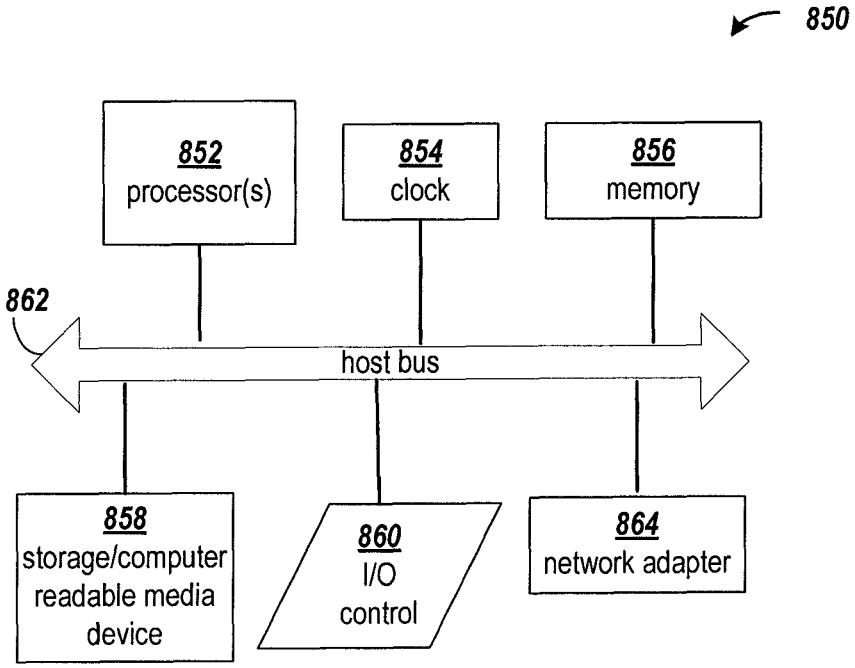
FIG. 12 is a block diagram of an example computing arrangement which can be configured to implement the processes performed by the preemption controller and central systems server described herein.

FIG. 12 is a block diagram of an example computing arrangement which can be configured to implement the processes performed by the preemption controller and central systems server described herein. Those skilled in the art will appreciate that various alternative computing arrangements, including one or more processors and a memory arrangement configured with program code, would be suitable for hosting the processes and data structures and implementing the algorithms of the different embodiments of the present invention. The computer code, comprising the processes of the present invention encoded in a processor executable format, may be stored and provided via a variety of computer-readable storage media or delivery channels such as magnetic or optical disks or tapes, electronic storage devices, or as application services over a network.

Processor computing arrangement 850 includes one or more processors 852, a clock signal generator 854, a memory unit 856, a storage unit 858, a network adapter 864, and an input/output control unit 860 coupled to host bus 862. The arrangement 850 may be implemented with separate components on a circuit board or may be implemented internally within an integrated circuit.

The architecture of the computing arrangement depends on implementation requirements as would be recognized by those skilled in the art. The processor 852 may be one or more general purpose processors, or a combination of one or more general purpose processors and suitable co-processors, or one or more specialized processors (e.g., RISC, CISC, pipelined, etc.).

The memory arrangement 856 typically includes multiple levels of cache memory and a main memory. The storage arrangement 858 may include local and/or remote persistent storage such as provided by magnetic disks (not shown), flash, EPROM, or other non-volatile data storage. The storage unit may be read or read/write capable. Further, the memory 856 and storage 858 may be combined in a single arrangement.

The processor arrangement 852 executes the software in storage 858 and/or memory 856 arrangements, reads data from and stores data to the storage 858 and/or memory 856 arrangements, and communicates with external devices through the input/output control arrangement 860 and network adapter 864. These functions are synchronized by the clock signal generator 854. The resources of the computing arrangement may be managed by either an operating system (not shown), or a hardware control unit (not shown).

The present invention is thought to be applicable to a variety of systems for a preemption controller. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for managing geographically dispersed traffic signal preemption control equipment, the traffic signal preemption control equipment including traffic signal preemption controllers and vehicle control units, comprising:

periodically reading logged preemption data stored at each of a plurality of intersections having respective preemption controllers for preempting traffic signals at the intersections, the preempting being in response to preemption requests from the vehicle control units, wherein the logged preemption data at an intersection describes operational states of the preemption controller and each vehicle control unit that submitted a preemption request at the intersection and data describing each individual preemption request;

storing the logged preemption data read from the plurality of intersections in a database in an electronic storage device;

monitoring the database having the logged preemption data from the plurality of intersections for data indicative of changes in operational status of the traffic signal preemption control equipment;

in response to the data indicating a change in operational status, outputting data descriptive of the change;

monitoring the database having the logged preemption data from the plurality of intersections for data indicative of an anomaly in operation of the preemption control equipment, the monitoring including comparing data from one of the plurality of intersections to data from others of the plurality of intersections; and outputting data indicative of the anomaly.

2. The method of claim 1, further comprising displaying on a display monitor a map of roadways and intersections including graphical icons indicative of the operational state of one or more of the preemption controllers.

3. The method of claim 1, further comprising:

monitoring the database having the logged preemption data from the plurality of intersections for data indicative of an anomaly in operation of the preemption control equipment; and outputting data indicative of the anomaly.

4. The method of claim 3, further comprising:

wherein the logged preemption data includes vehicle control unit signal strength values for preemption requests from vehicle control units;

wherein the monitoring the database for an anomaly includes comparing a plurality of vehicle control unit signal strength values recorded in the database for a particular vehicle control unit to detect an anomaly with the particular vehicle control unit.

5. The method of claim 3, further comprising:

wherein the logged preemption data includes vehicle control unit signal strength values for preemption requests from vehicle control units;

wherein the monitoring the database for an anomaly includes comparing a plurality of vehicle control unit signal strength values recorded in the database and associated with a particular preemption controller to detect an anomaly with the particular preemption controller.

6. The method of claim 1, further comprising monitoring the database having the logged preemption data from the plurality of intersections for data indicative of misuse of the preemption control equipment by a particular vehicle control unit.

7. The method of claim 1, further comprising:

wherein the logged preemption data includes times of preemption requests, locations of vehicle control units making the preemption requests, and vehicle identifiers of the vehicle control units making the preemption requests;

monitoring the database for logged data that matches event criteria; and in response to logged data in the database matching the event criteria, transmitting a time of preemption request, a location of a vehicle control unit making the preemption request, and a vehicle identifier of the vehicle control unit making the preemption request.

8. The method of claim 1, further comprising:

displaying a map of roadways and intersections;

wherein the monitoring of the database includes monitoring for a change in operational status of any of the preemption controllers; and in response to a change in operational status of a preemption controller, displaying an icon indicative of the change in operational status of the preemption controller at one of the intersections representing a physical intersection at which the preemption controller is located.

9. The method of claim 1, further comprising:

displaying a map of roadways and intersections;

wherein the monitoring of the database includes monitoring for new preemption requests; and in response to each new preemption request, displaying an icon, that is representative of a vehicle having a vehicle control unit that made the preemption request, on the map at a position corresponding to a physical location of the vehicle.

10. The method of claim 9, further comprising:

requesting location data from one or more vehicle control units;

storing the location data from the one or more vehicle control units in the database;

wherein the monitoring of the database includes monitoring for changed location data from the one or more vehicle control units; and in response to changed location data of one of the one or more vehicle control units, displaying an icon, that is representative of the one of the one or more vehicle control units, on the map at a position corresponding to a physical location of the one of the one or more vehicle control units.

11. A system for managing geographically dispersed traffic signal preemption control equipment, the traffic signal preemption control equipment including traffic signal preemption controllers and vehicle control units, comprising:

a processor;

a memory arrangement coupled to the processor, wherein the memory arrangement is configured with instructions for execution by the processor, wherein the instructions include:

a first module for periodically reading logged preemption data stored at each of a plurality of intersections having respective preemption controllers for preempting traffic signals at the intersections, the preempting being in response to preemption requests from the vehicle control units, and storing the logged preemption data read from the plurality of intersections in a database in the memory arrangement, wherein the logged preemption data at an intersection describes operational characteristics of the preemption controller and each vehicle control unit that submitted a preemption request at the intersection and data describing each individual preemption request;

a second module for monitoring the database having the logged preemption data from the plurality of intersections for data indicative of changes in operational status of the traffic signal preemption control equipment; and a third module, responsive to the data indicating a change in operational status, for outputting data for graphical display on a map of roadways and intersections, the data for graphical display including graphical icons indicative of the operational status of the preemption control equipment at map locations corresponding to geographic locations of the preemption control equipment;

wherein the instructions of the second module monitor the database having the logged preemption data from the plurality of intersections for data indicative of an anomaly in operation of the preemption control equipment, the monitoring including comparing data from one of the plurality of intersections to data from others of the plurality of intersections; and the instructions of the third module output data indicative of the anomaly.

12. The system of claim 11, wherein:

the second module is further configured to monitor the database having the logged preemption data from the plurality of intersections for data indicative of an anomaly in operation of the preemption control equipment; and the third module is further configured to output data indicative of the anomaly.

13. The system of claim 12, further comprising:

wherein the logged preemption data includes vehicle control unit signal strength values for preemption requests from vehicle control units;

wherein the second module is further configured to monitor the database for an anomaly includes comparing a plurality of vehicle control unit signal strength values recorded in the database for a particular vehicle control unit to detect an anomaly with the particular vehicle control unit.

14. The system of claim 12, further comprising:

wherein the logged preemption data includes vehicle control unit signal strength values for preemption requests from vehicle control units;

wherein the second module is further configured to monitor the database for an anomaly includes comparing a plurality of vehicle control unit signal strength values recorded in the database and associated with a particular preemption controller to detect an anomaly with the particular preemption controller.

15. The system of claim 11, wherein the second module is further configured to monitor the database having the logged preemption data from the plurality of intersections for data indicative of misuse of the preemption control equipment by a particular vehicle control unit.

16. The system of claim 11, wherein:

the logged preemption data includes times of preemption requests, locations of vehicle control units making the preemption requests, and vehicle identifiers of the vehicle control units making the preemption requests;

the second module is further configured to monitor the database for logged data that matches event criteria, and in response to logged data in the database matching the event criteria, transmit a time of preemption request, a location of a vehicle control unit making the preemption request, and a vehicle identifier of the vehicle control unit making the preemption request.

17. The system of claim 11, wherein:

the second module is further configured to monitor the database for a change in operational status of any of the preemption controllers; and the third module is further configured to, in response to a change in operational status of a preemption controller, display an icon indicative of the change in operational status of the preemption controller at one of the intersections representing a physical intersection at which the preemption controller is located.

18. The system of claim 11, wherein:

the second module is further configured to monitor the database for new preemption requests; and the third module is further configured to, in response to each new preemption request, display an icon, that is representative of a vehicle having a vehicle control unit that made the preemption request, on the map at a position corresponding to a physical location of the vehicle.

19. The system of claim 18, wherein:

the first module is further configured to request location data from one or more vehicle control units and store the location data from the one or more vehicle control units in the database;

the second module is further configured to monitor the database for changed location data from the one or more vehicle control units; and the third module is further configured to, in response to changed location data of one of the one or more vehicle control units, display an icon, that is representative of the one of the one or more vehicle control units, on the map at a position corresponding to a physical location of the one of the one or more vehicle control units.

20. An article of manufacture, comprising:

a processor-readable storage device configured with instructions for managing geographically dispersed traffic signal preemption control equipment, the traffic signal preemption control equipment including traffic signal preemption controllers and vehicle control units, wherein in executing the instructions by one or more processors causes the one or more processors to perform the operations including:

periodically reading logged preemption data stored at each of a plurality of intersections having respective preemption controllers for preempting traffic signals at the intersections, the preempting being in response to preemption requests from the vehicle control units, wherein the logged preemption data at an intersection describes operational states of the preemption controller and each vehicle control unit that submitted a preemption request at the intersection and data describing each individual preemption request;

storing the logged preemption data read from the plurality of intersections in a database in an electronic storage device;

monitoring the database having the logged preemption data from the plurality of intersections for data indicative of changes in operational status of the traffic signal preemption control equipment; and in response to the data indicating a change in operational status, outputting data descriptive of the change;

monitoring the database having the logged preemption data from the plurality of intersections for data indicative of an anomaly in operation of the preemption control equipment, the monitoring including comparing data from one of the plurality of intersections to data from others of the plurality of intersections; and outputting data indicative of the anomaly.

* * * * *